US007316720B2

(12) United States Patent
Cuppari et al.

(10) Patent No.: US 7,316,720 B2
(45) Date of Patent: Jan. 8, 2008

(54) SECURING DEVICE FOR A FILTER ELEMENT

(75) Inventors: Fabiana Cuppari, Cachoeira Paulista-Sp (BR); Egon Feisthammel, Rastatt (DE); Dieter Rosmann, Stuttgart (DE); Sven Wlodarczyk, Karlsruhe (DE)

(73) Assignee: BSH Bosch und Siemens Hausgeraete GmbH, Munich (DE)

( * ) Notice: Subject to any disclaimer, the term of this patent is extended or adjusted under 35 U.S.C. 154(b) by 0 days.

(21) Appl. No.: 10/873,48

(22) Filed: Jun. 21, 2004
(Under 37 CFR 1.47)

(65) Prior Publication Data

US 2006/0150595 A1 Jul. 13, 2006

Related U.S. Application Data

(63) Continuation of application No. PCT/EP02/13396, filed on Nov. 27, 2002.

(30) Foreign Application Priority Data

Dec. 20, 2001 (DE) ..... 101 62 921

(51) Int. Cl.
*F24C 15/20* (2006.01)

(52) U.S. Cl. ..... 55/385.1; 55/471; 55/472; 55/473; 55/DIG. 36; 55/490; 55/493; 96/415; 96/416; 454/63; 454/64; 454/65; 454/66; 454/67; 126/299 D; 126/299 E; 126/299 F

(58) Field of Classification Search ..... 55/385.1, 55/DIG. 36, 471–473, 490, 493; 126/299 D, 126/299 E, 299 F; 454/63–67; 96/415, 96/416

See application file for complete search history.

(56) References Cited

U.S. PATENT DOCUMENTS

| | | | | |
|---|---|---|---|---|
| 2,528,844 | A * | 11/1950 | Robertson | 126/299 D |
| 2,862,437 | A * | 12/1958 | Smith et al. | 126/299 D |
| 3,357,763 | A * | 12/1967 | Toper | 312/236 |
| 3,853,343 | A | 12/1974 | Hunter | |
| 3,954,427 | A * | 5/1976 | Jenn | 96/407 |
| 4,623,180 | A | 11/1986 | Zimmerly | |
| 5,387,018 | A | 2/1995 | Pinkerton | |
| 6,202,641 | B1 * | 3/2001 | Lazzaro | 126/299 D |
| 6,293,983 | B1 | 9/2001 | More | |
| 6,447,586 | B1 * | 9/2002 | Campbell | 96/415 |

FOREIGN PATENT DOCUMENTS

| | | |
|---|---|---|
| DE | 358 669 | 9/1922 |
| DE | 1 179 133 | 6/1965 |
| DE | 199 57 196 A1 | 7/2001 |
| EP | 1 291 584 A2 | 3/2003 |
| GB | 1 520 429 | 8/1978 |
| GB | 2 366 320 A | 3/2002 |

* cited by examiner

*Primary Examiner*—Duane Smith
*Assistant Examiner*—Minh-Chau T. Pham
(74) *Attorney, Agent, or Firm*—Russell W. Warnock; James E. Howard

(57) ABSTRACT

A securing device for a filter element, which can be detachably mounted on an extractor hood, has a connecting implement for detachably connecting the filter element to the associated extractor hood. The connecting implement catches the filter element when detaching the filter element from the extractor hood and prevents it from falling down. The connecting implement has a fixing element with a rod-like section and with a thickening connected thereto. The connecting implement also has a closure element with a U-shaped slot. The rod-like section of the fixing element is formed so that it fits the U-shaped slot of the closure element.

22 Claims, 1 Drawing Sheet

SECURING DEVICE FOR A FILTER ELEMENT

CROSS-REFERENCE TO RELATED APPLICATION

This application is a continuation, under 35 U.S.C. § 120, of copending international application No. PCT/EP02/13396, filed Nov. 27, 2002, which designated the United States; this application also claims the priority, under 35 U.S.C. § 119, of German patent application No. 101 62 921.4, filed Dec. 20, 2001; the prior applications are herewith incorporated by reference in their entirety.

BACKGROUND OF THE INVENTION

Field of the Invention

The present invention relates to a securing device for a filter element that can be detachably mounted on an extractor hood.

Extractor hoods are provided with removable filters, in particular, grease filters, to permit cleaning and/or changing of the filter. The filter elements can be fastened in the extraction opening of an extractor hood by a fastening device, for example, a locking device or a bolt connection. The release of the fastening device of the filter element is generally explained in the instructions for use. Because the filter has to be exchanged or cleaned at relatively long intervals (about 4 to 8 weeks), there is the risk of the user having forgotten the directions for removing the filter element and not using the instructions for use, with the result that, sometimes, the filter element is improperly removed. In the worst case, this may lead to the filter element being able to fall from the extractor hood onto the cooktop located underneath during the detachment. This may, on one hand, have the effect of the filter element, itself, being damaged or destroyed or, on the other hand, the cooktop, such as, for example, a glass ceramic cooktop, may be damaged or destroyed.

It is known to fasten, in the extraction opening of an extractor hood, a chain that has at its free end a carabiner hook to which the filter element can be fastened. In the event of improper detachment of the filter element, the chain, therefore, catches the filter element. A disadvantage of such a securing device is that, during the operation of the extractor hood, the chain and the carabiner hook cause a troublesome noise, such as rattling, for example, to be produced as a result of the fan. Furthermore, such a device is very complex because an eyelet has to be provided both on the filter element and in the extractor hood in order to fasten the chain or the carabiner hook respectively thereto.

SUMMARY OF THE INVENTION

It is accordingly an object of the invention to provide a securing device for a filter element that overcomes the hereinafore-mentioned disadvantages of the heretofore-known devices of this general type and that is detachably mounted on an extractor hood, is of a simple construction, produces little noise, is easy to use, and is operationally reliable.

With the foregoing and other objects in view, there is provided, in accordance with the invention, a securing device for a filter element detachably mounted on an extractor hood, the securing device including a connecting device for detachably connecting the filter element to an associated extractor hood, the connecting device catching the filter element when the filter element is detached from the extractor hood and securing the filter element to prevent the filter element from falling, and the connecting device having a fastening element having a rod-shaped portion and a thickening connected to the rod-shaped portion, a closure element defining a U-shaped slot, and the rod-shaped portion of the fastening element being shaped to fit the U-shaped slot of the closure element.

The securing device for a filter element that can be detachably mounted on an extractor hood has a connecting device for detachably connecting the filter element to the associated extractor hood, the connecting device catching the filter element when it is detached from the extractor hood and securing it to prevent it from falling. By providing the connecting device with a fastening element with a rod-like portion and a thickening connected thereto and having a closure element with a U-shaped slot, the rod-like portion of the fastening element being formed such that it fits the U-shaped slot of the closure element, a very simple and easy to handle connecting device is provided. This is true because all that is required to complete the connection is to insert the fastening element with its rod-like portion into the U-shaped slot of the closure element.

By the rod-like portion of the fastening element being formed such that it fits the U-shaped slot of the closure element, on one hand, a secure connection that cannot loosen itself is provided and, on the other hand, relative movements between the parts are avoided. Thus, no vibrational noises can be produced.

In an advantageous configuration, the connecting device has a strip, one end of the strip being fastened either to the filter element or to the extractor hood and the other end of the strip being provided either with the fastening element or with the closure element, the respective counterpart, either the closure element or the fastening element, being fastened either to the filter element or to the extractor hood. This makes it possible to form the U-shaped slot of the fastening element in a simple way—either integrally on the housing of the extractor hood or integrally on the filter element. As such, a very simply constructed connecting device is provided.

In accordance with another feature of the invention, the strip is produced from an elastic material, preferably, plastic, and, in particular, a deformable thermoplastic. By providing elastic material for the strip, on one hand, a falling filter element is caught without impact and, on the other hand, an elastic material has very high intrinsic damping so that vibrational excitation by the fan is suppressed and, consequently, generation of noise is prevented.

In accordance with a further feature of the invention, the length of the strip is predetermined such that the filter element hanging from the strip does not touch a cooktop located underneath. In the event that a filter element falls when it is being exchanged or changed, the cooktop located underneath is protected, in particular, from damage.

In accordance with an added feature of the invention, the strip is provided with a bright color so that the user of the extractor hood cannot overlook the connecting device when refitting the filter element and is reminded to insert the fastening element into the closure element. The color is in visually perceptible contrast with the background, in particular, the cooktop or hood, in particular, yellow, orange, and/or red. The connecting device can be of a fluorescent material.

In accordance with an additional feature of the invention, the U-shaped slot of the fastening element has a constriction at its opening. Such a configuration makes it possible to keep the fastening element with its rod-like portion securely in the mounted state.

In accordance with yet another feature of the invention, the U-shaped slot is formed in a sheet metal portion of the filter element or of the extractor hood. This allows the closure element to be produced in a particularly simple way.

In accordance with yet a further feature of the invention the opening of the U-shaped slot is adjoined by a large opening for the insertion of the thickening of the fastening element and is, consequently, formed in the shape of a keyhole, and the thickening is formed in the shape of a ball. Such a shaping ensures simple connecting of the fastening element to the closure element.

With the objects of the invention in view, in an extractor hood having a filter element detachably mounted thereto, there is also provided a securing device including a connecting device detachably connecting the filter element to the extractor hood and catching the filter element when the filter element is detached from the extractor hood and securing the filter element to prevent the filter element from falling, the connecting device having a fastening element having a rod-shaped portion and a thickening connected to the rod-shaped portion, a closure element defining a U-shaped slot, and the rod-shaped portion of the fastening element being shaped to fit the U-shaped slot of the closure element.

With the objects of the invention in view, there is also provided a securing device for a filter element detachably mounted on an extractor hood, the securing device including a connecting device for detachably connecting the filter element to an associated extractor hood, the connecting device catching the filter element when the filter element is detached from the extractor hood and securing the filter element to prevent the filter element from falling and the connecting device having a fastening element having a rod-shaped portion and a thickening connected to the rod-shaped portion, a closure element defining a keyhole, the keyhole having a relatively larger opening and a relatively smaller slot having a given diameter, the rod-shaped portion and the thickening being shaped to fit in the keyhole, and the rod-shaped portion having a diameter approximately equal to the given diameter.

Other features that are considered as characteristic for the invention are set forth in the appended claims.

Although the invention is illustrated and described herein as embodied in a securing device for a filter element, it is, nevertheless, not intended to be limited to the details shown because various modifications and structural changes may be made therein without departing from the spirit of the invention and within the scope and range of equivalents of the claims.

The construction and method of operation of the invention, however, together with additional objects and advantages thereof, will be best understood from the following description of specific embodiments when read in connection with the accompanying drawings.

DESCRIPTION OF THE PREFERRED EMBODIMENTS

Figure 1:
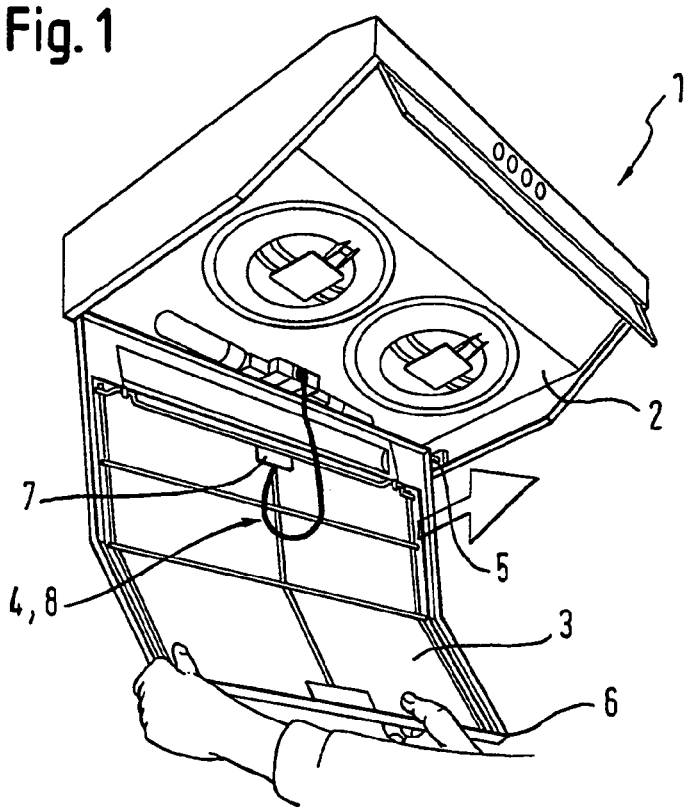
FIG. 1 is a fragmentary perspective view of an extractor hood with a securing device with which the filter element is detached/mounted and a user operating the filter element.
Figure 2:
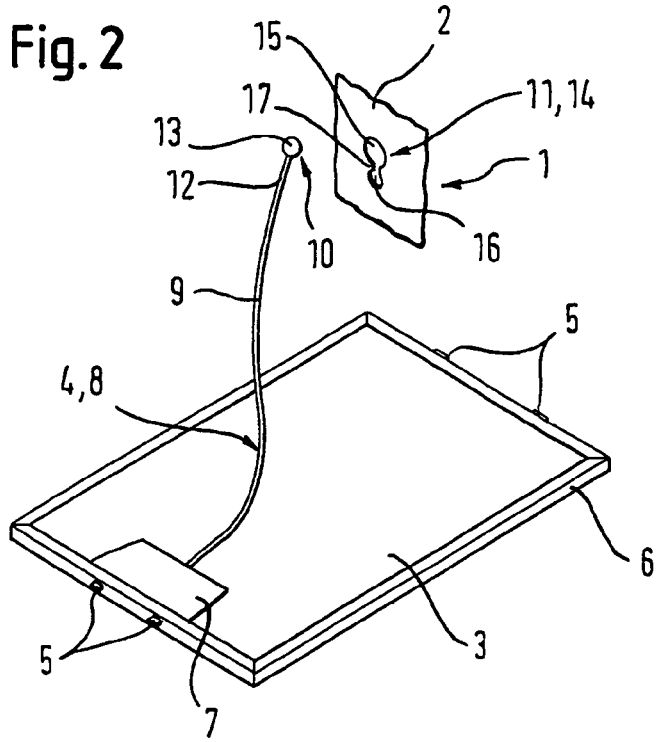
FIG. 2 is a fragmentary, enlarged, perspective view of the securing device of FIG. 1.

Referring now to the figures of the drawings in detail and first, particularly to FIGS. 1 and 2 thereof, there is shown an extractor hood 1 with a housing 2, a filter element 3, and a securing device 4 disposed between the filter element 3 and the housing 2. The filter element 3 is fastened to the housing 2 of the extractor hood 1 by a fastening device 5, such as, for example, a bolt connection according to FIG. 1 or a bar connection according to FIG. 2. For removing or detaching the filter element 3 from the housing 2, first, the fastening device 5 must be released, as can be seen in FIG. 1. After releasing the fastening device 5, there is the risk of the filter element 3 falling from the user's hand, due to unattentiveness, and crashing onto a non-illustrated cooktop disposed underneath, which may lead to damage to or destruction of both the filter element 3 and of the cooktop. To prevent such a circumstance, the securing device 4 provided between the filter element 3 and the housing 2 of the extractor hood 1 catches the filter element 3.

According to FIG. 2, the filter element 3 has a frame 6 with a butt strap 7 fastened to the frame 6. In FIG. 2, the housing 2 of the extractor hood 1 is merely represented as a small cutout of a sheet metal part in the interior of the housing 2.

The securing device 4 is formed as a connecting device 8, which includes a strip 9, a fastening element 10, and a closure element 11. The strip 9 is fastened by its one end to the butt strap 7 of the filter element 3 and is provided at its other end with the fastening element 10, which includes a rod-like portion 12 and a thickening 13 adjoining the rod-like portion 12. In the present case, the rod-like portion 12 is formed integrally with the strip 9. The closure element 11 is formed integrally as a keyhole-shaped opening 14 in a metal sheet or a butt strap of the housing 2 of the extractor hood 1. The keyhole-shaped opening 14 has a large opening 15 and a U-shaped slot 16 adjoining the large opening 15. The large opening 15 is dimensioned such that the thickening 13 fits therethrough. The U-shaped slot 16 is dimensioned in its widthwise extent such that the rod-like portion 12 fits snugly up against the thickening 13. In the transitional region to the large opening 15, the U-shaped slot 16 has a constriction 17.

The strip is, preferably, produced from elastic material, in particular, plastic or a deformable thermoplastic. The length of the strip 9 is configured such that the filter element 3 hanging from the strip cannot touch a cooktop located underneath. The thickening 13 is, preferably, formed in the shape of a ball.

For mounting the connecting device 8, the strip 9 is inserted with the thickening 13 formed on it through the large opening 15 of the keyhole-shaped opening 14 and, then, inserted with its rod-like portion 12 toward the constriction 17 into the U-shaped slot 16. The detachment of the connecting device 8 takes place in the opposite sequence.

The strip 9, the fastening element 10, and the closure element 11 are provided with a bright color, preferably, yellow, orange, or red, or they are of a fluorescent material.

The U-shaped slot 16 is disposed such that, in the event of the filter element 3 falling, the rod-like portion 12 is pulled into the U-shaped slot 16.

Instead of fastening the closure element 11 with the keyhole-shaped opening 14 to the housing 2 of the extractor hood, the closure element 11 may also be formed on the filter element 3, in particular, the frame 6 or the butt strap 7. In such a case, one end of the strip 9 is fastened to the housing 2 of the extractor hood 1.

Instead of providing the closure element 11 on the housing 2 or on the filter element 3, the closure element 11 may also be fastened to the free end of the strip 9. In such a case, the thickening 13 is disposed with the rod-like portion 12 formed on it on the housing 2 or on the filter element 3 in the form of a non-illustrated nail-shaped pin.

The securing device 4 formed above as a connecting device 8 has the advantage of a low complexity of parts because all the functional components, such as the closure element 11 or fastening element 10, can be formed integrally on the housing 2 or on the filter element 3.

The securing device 4 represented above is of a simple construction and is easy to handle. Thus, operating errors, such as, for example, not hanging the fastening element 10 in the closure element 11 when mounting a new filter element 3 on the housing 2 of the extractor hood 1, can be ruled out.

The securing device 4 represented above has the advantage of taking up little stowage space.

We claim:

1. A securing device for a filter element detachably mounted on an extractor hood, the securing device comprising:

a connecting device for detachably connecting the filter element to an associated extractor hood, said connecting device catching the filter element when the filter element is detached from the extractor hood and securing the filter element to prevent the filter element from falling; and said connecting device having:

a fastening element having a rod-shaped portion and a thickening connected to said rod-shaped portion;

a closure element defining a U-shaped slot; and said rod-shaped portion of said fastening element being shaped to fit said U-shaped slot of said closure element.

2. The securing device according to claim 1, wherein:

said connecting device has a continuous strip with first and second ends;

said first end of said strip has one of a first group consisting of said fastening element and said closure element;

said second end of said strip is configured to be fastened to one of a second group consisting of the filter element and the extractor hood; and the other one of the first group consisting of said fastening element and said closure element is to be fastened to the other one of the second group consisting of the filter element and the extractor hood.

3. The securing device according to claim 2, wherein said strip is of a material selected from the group consisting of an elastic material, plastic, and a deformable thermoplastic.

4. The securing device according to claim 1, wherein said connecting device has a predetermined length preventing the filter element hanging from the connecting device to not touch a cooktop located thereunder.

5. The securing device according to claim 1, wherein said connecting device has a bright color.

6. The securing device according to claim 1, wherein said connecting device has a visually perceptible color contrasting with a background.

7. The securing device according to claim 6, wherein said color is at least one of the group consisting of yellow, orange, and red.

8. The securing device according to claim 6, wherein said connecting device is of a fluorescent material.

9. The securing device according to claim 1, wherein said U-shaped slot has an open side and a constriction at said open side.

10. The securing device according to claim 1, wherein said U-shaped slot is formed in a sheet metal portion of one of the filter element and the extractor hood.

11. The securing device according to claim 1, wherein:

said thickening is ball-shaped;

said U-shaped slot has an open side; and said closure element defines a keyhole having:

a relatively larger opening having a size and shape sufficiently large enough to insert said thickening therethrough; and said U-shaped slot, said U-shaped slot being relatively smaller than said larger opening and said open side adjoining said larger opening.

12. In an extractor hood having a filter element detachably mounted thereto, a securing device comprising:

a connecting device detachably connecting the filter element to the extractor hood and catching the filter element when the filter element is detached from the extractor hood and securing the filter element to prevent the filter element from falling, said connecting device having:

a fastening element having a rod-shaped portion and a thickening connected to said rod-shaped portion;

a closure element defining a U-shaped slot; and said rod-shaped portion of said fastening element being shaped to fit said U-shaped slot of said closure element.

13. The securing device according to claim 12, wherein:

said connecting device has a continuous strip with first and second ends;

said first end of said strip has one of a first group consisting of said fastening element and said closure element;

said second end of said strip is configured to be fastened to one of a second group consisting of the filter element and the extractor hood; and the other one of the first group consisting of said fastening element and said closure element is to be fastened to the other one of the second group consisting of the filter element and the extractor hood.

14. The securing device according to claim 12, wherein said strip is of a material selected from the group consisting of an elastic material, plastic, and a deformable thermoplastic.

15. The securing device according to claim 12, wherein said connecting device has a predetermined length preventing the filter element hanging from the connecting device to not touch a cooktop located thereunder.

16. The securing device according to claim 12, wherein said connecting device has a visually perceptible color which is one of yellow, orange and red, and contrasting with a background.

17. The securing device according to claim 16, wherein said connecting device is of a fluorescent material.

18. The securing device according to claim 12, wherein said U-shaped slot has an open side and a constriction at said open side.

19. The securing device according to claim 12, wherein:

one of the filter element and the extractor hood has a sheet metal portion; and said U-shaped slot is formed in the sheet metal portion.

20. The securing device according to claim 12, wherein:

said thickening is ball-shaped;

said U-shaped slot has an open side; and said closure element defines a keyhole having:

a relatively larger opening having a size and shape sufficiently large enough to insert said thickening therethrough; and said U-shaped slot, said U-shaped slot being relatively smaller than said larger opening and said open side adjoining said larger opening.

21. A securing device for a filter element detachably mounted on an extractor hood, the securing device comprising:

a connecting device for detachably connecting the filter element to an associated extractor hood, said connecting device catching the filter element when the filter element is detached from the extractor hood and securing the filter element to prevent the filter element from falling; and said connecting device having:

a fastening element having:

a rod-shaped portion; and a thickening connected to said rod-shaped portion;

a closure element defining a keyhole, said keyhole having:

a relatively larger opening; and a relatively smaller slot having a given diameter;

said rod-shaped portion and said thickening being shaped to fit in said keyhole; and said rod-shaped portion having a diameter approximately equal to said given diameter.

22. The securing device according to claim 1 wherein said connecting device includes a generally elastic continuous strip extending between said filter element and said fastening element.

* * * * *

UNITED STATES PATENT AND TRADEMARK OFFICE

CERTIFICATE OF CORRECTION

PATENT NO. : 7,316,720 B2
APPLICATION NO. : 10/873428
DATED : January 8, 2008
INVENTOR(S) : Fabiana Cuppari et al.

It is certified that error appears in the above-identified patent and that said Letters Patent is hereby corrected as shown below:

On the Title Page,

Item (21) it reads:
(21) Appll. No.: 10/873,48

Item (21) should read:
(21) Appl. No.: 10/873,428

Signed and Sealed this
Nineteenth Day of April, 2011

David J. Kappos

David J. Kappos
*Director of the United States Patent and Trademark Office*